US011624202B2

(12) United States Patent
Hiner et al.

(10) Patent No.: US 11,624,202 B2
(45) Date of Patent: Apr. 11, 2023

(54) SPRING WIRE CLIP

(71) Applicant: Lock Jawz LLC, Georgetown, IN (US)

(72) Inventors: Nicholas Andrew Hiner, Georgetown, IN (US); Alan Wade Simon, Portland, TN (US)

(73) Assignee: LOCK JAWZ LLC, Georgetown, IN (US)

( * ) Notice: Subject to any disclaimer, the term of this patent is extended or adjusted under 35 U.S.C. 154(b) by 124 days.

(21) Appl. No.: 16/789,392

(22) Filed: Feb. 12, 2020

(65) Prior Publication Data

US 2020/0256085 A1 Aug. 13, 2020

Related U.S. Application Data

(60) Provisional application No. 62/804,463, filed on Feb. 12, 2019.

(51) Int. Cl.
*E04H 17/10* (2006.01)

(52) U.S. Cl.
CPC ..... *E04H 17/124* (2021.01)

(58) Field of Classification Search
CPC ..... E04H 17/02; E04H 17/04; E04H 17/06; E04H 17/10; E04H 17/124; E04H 17/26; E04H 17/261; E04H 17/268
See application file for complete search history.

(56) References Cited

U.S. PATENT DOCUMENTS

| | | | | | |
|---|---|---|---|---|---|
| 642,053 | A | * | 1/1900 | Rea | |
| 858,345 | A | * | 6/1907 | Kaufman | |
| 1,848,515 | A | * | 5/1928 | Davidson | |
| 1,761,452 | A | * | 12/1928 | Paque | |
| 1,791,692 | A | * | 2/1929 | Swenson | |
| 2,150,291 | A | * | 3/1939 | Paque | E04H 12/2215 52/153 |
| 2,227,553 | A | * | 1/1941 | Paque | E04H 17/06 52/153 |
| 2,702,182 | A | * | 2/1955 | Wenger | E04H 17/10 256/48 |
| 3,080,149 | A | * | 3/1963 | Pilboue | E04H 17/06 256/57 |
| 3,161,263 | A | * | 12/1964 | Stokes | E04H 17/10 248/218.4 |
| 3,169,750 | A | * | 2/1965 | Weed | E04H 17/10 256/57 |
| 3,394,922 | A | * | 7/1968 | Bradbury | E04H 17/10 256/57 |
| 3,977,653 | A | * | 8/1976 | Fingerson | E04H 17/10 256/10 |

(Continued)

*Primary Examiner* — Jonathan P Masinick
(74) *Attorney, Agent, or Firm* — Scott Houtteman; Houtteman Law, LLC

(57) ABSTRACT

The spring wire clip fastens fence wire to T-posts. The clip is constructed from hardened high carbon spring steel and has a geometry that allows the clip to be installed with no tools. The middle of the clip has a shape complementary to the T-post spine, typically a "V" shape, such that the clip wraps around the spine and the two ends extend laterally. Each end has a curl that can engage the fence wire on either side of the T-post. The clips can be installed five times faster than with standard twist-type clips and can be repositioned, or reused, as the attachment is not permanent.

9 Claims, 2 Drawing Sheets

(56) References Cited

U.S. PATENT DOCUMENTS

| | | | | |
|---|---|---|---|---|
| 4,893,788 | A * | 1/1990 | Chave | A01K 3/005 256/47 |
| 6,499,514 | B1 * | 12/2002 | Hodge, Sr. | B25B 31/00 140/52 |
| 6,802,495 | B1 * | 10/2004 | Schmidt | E04H 17/10 256/2 |
| 7,108,021 | B2 * | 9/2006 | Lile, Jr. | B21F 9/00 140/117 |
| 2002/0153054 | A1 * | 10/2002 | Wierzbicki | B21F 27/08 140/11 |
| 2005/0189531 | A1 * | 5/2005 | Bechtel | E04H 17/02 256/47 |
| 2010/0283023 | A1 * | 11/2010 | Thompson | 256/35 |
| 2013/0328000 | A1 * | 12/2013 | Hendricks | E04H 17/04 256/10 |
| 2020/0102105 | A1 * | 4/2020 | Seesing | B25B 31/00 |

* cited by examiner

SPRING WIRE CLIP

This application claims benefit to U.S. Provisional Application 62/804,463, filed Feb. 12, 2019. The present invention relates to a wire clips, particularly to attach wire to T-posts used in fencing.

BACKGROUND

In a common configuration design, fencing wire is attached to a fence T-post between two nodes with a wire clip that wraps around the T-post and hooks into the wire from both lateral sides of the T-post. The wire clips typically engage the fencing wire in the horizontal direction and the T-post in the vertical, but not limited by such attachment. The prior art wire clips suffer certain disadvantages. In particular, these prior art clips are made from a soft low carbon steel that have to be installed with a tool by twisting around the wire to make a secure connection. When the clips are installed on a woven wire fence, it is very difficult to twist using the tool due to the smaller openings between the strands of woven wire. The prior art clips are also time consuming to install and have little or no adjustment mechanism after installation. Typically, these prior art clips are a one-time use and if they need to be adjusted are cut from the fence and a new clip must be used.

DETAILED DESCRIPTION

Wire clips are used to attach fence wire to fence posts. To construct a typical fence line, the caretaker of a plot of land installs a series of vertical fence posts in a line. Quite commonly this series of fence post is arrayed in a literal line, but, of course, the caretaker can deploy the "line" of fence posts in any convenient shape to fence off a desired area. Commonly, the caretaker uses T-posts. The caretaker will also string one or more fence wires, typically in a horizontal direction, along the fence line. The caretaker will commonly attach the horizontal fence wire each of the posts in the fence line.

In prior art fence lines, the fence wire was attached to the fence posts using flexible wire. The wire, we estimate the shear strength at approximately 50-80 Ksi, engages the fence wire in some fashion and is then wrapped around the fence post using tools such as fencing pliers or a clip bender tool. In the case of T-posts the fence wire is typically run above the studs on the front of the post. The fence wire is attached to the T-post with a flexible wire, and a tool is used to twist the wire much like a "twist tie." That is, one end of the flexible wire is twisted around the fence wire at a point near one lateral side of the T-post. The flexible wire is run behind the spine of the T-post and the other end of the flexible wire is wrapped around the fence wire on the other lateral side of the fence post. In fact, any method of wrapping the flexible wire around the fence wire will work so long as the flexible wire keeps the fence wire in contact with the T-post. The fence wire will remain in place above the stud on the face of the T-post.

Typically, the wire used in the prior art to secure fence wire to T-posts is a form of low carbon soft steel. The critical feature being that the attachment wire be bendable. The inventors of this application found, surprisingly, that relatively stiff, unbending wire can be used in a new type of "fence clip." While any type of stiff wire can be used, a preferred embodiment is 300 Ksi (shear strength) wire having a diameter of 0.99 inch to 0.105 inch.

More generally speaking, the spring wire clip is made from wire having a shear strength in the range of 125 to 600 Ksi, and a diameter from 0.075 to 0.15 inches. In another embodiment, music wire, having a shear strength of 300 to 400 Ksi will also function.

In still another embodiment the spring wire clip can be made from high carbon spring tempered steel alloy having a shear strength in the range from 282K to 312K and a diameter from 0.080 to 0.1 inches. More preferable, a shear strength of about 300 Ksi. Note, the American Iron and Steel Institute (AISI) defines "high carbon steel" as containing from 0.60 to 1.00% carbon by weight.

Figure 1:
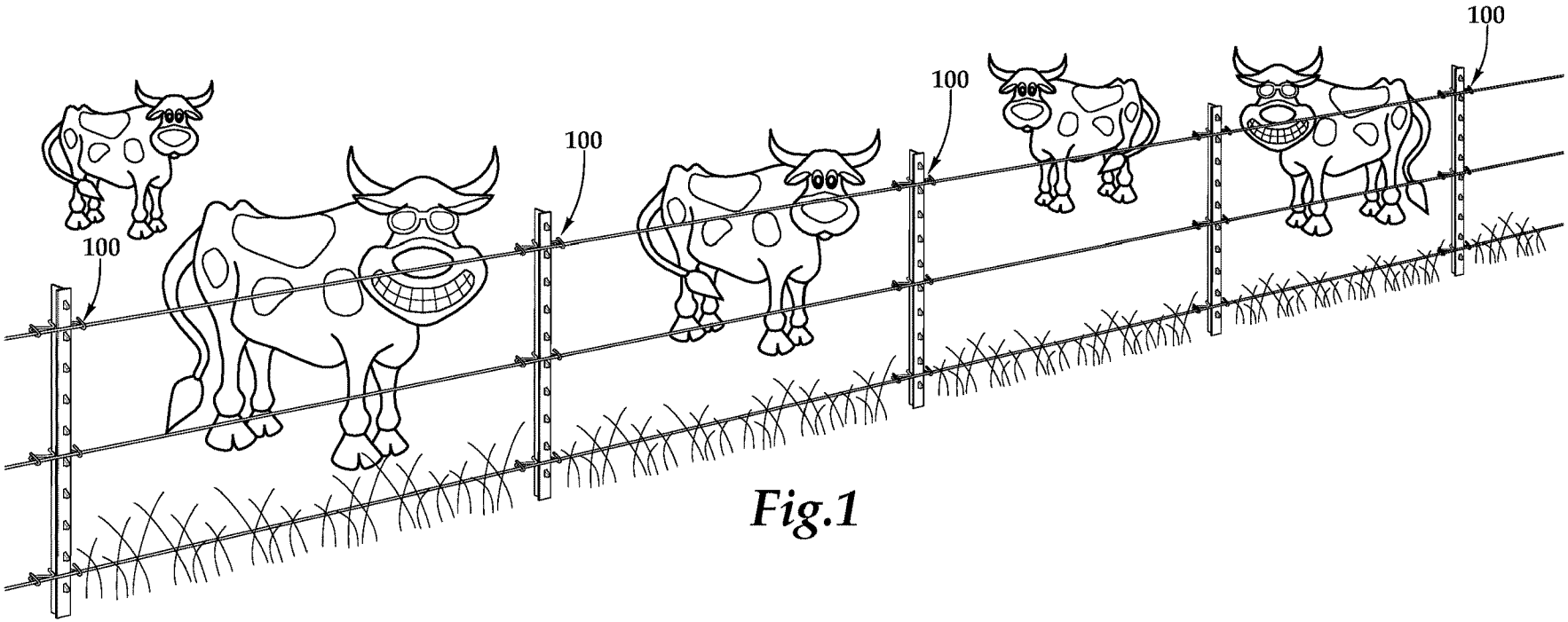
FIG. 1 is a fence line with spring wire clips

FIG. 1 shows a T-post fence line with the spring wire clips 100 holding the horizontal fence wire to the T-posts.

Figure 2:
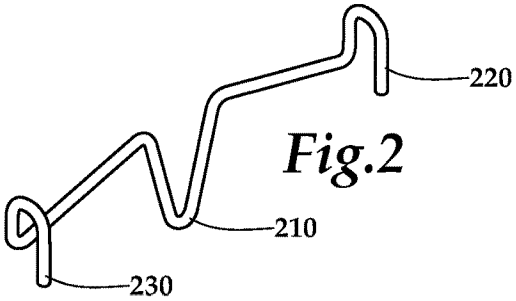
FIG. 2 is an axonometric view of the spring wire clip.

FIG. 2 is an axiomatic view of the spring wire clip. The wire making up the clip is preformed into this shape. It is curled at both ends 220, 230. Because the wire shear strength is so high, these ends are formed by a hydraulic press exerting a force of approximately 850 psi. The central portion of the wire 210 requires even more force. The hydraulic press exerts approximately 1200 psi to form this "V" shape. Note, the length from the center 210 to the ends 220, 230 is equal in this picture. In certain preferred embodiments, these two "arms" of the clip need not be of equal length. Also, for thicker fence wire, e.g. cattle panels, one can use longer side arms.

Figure 3:
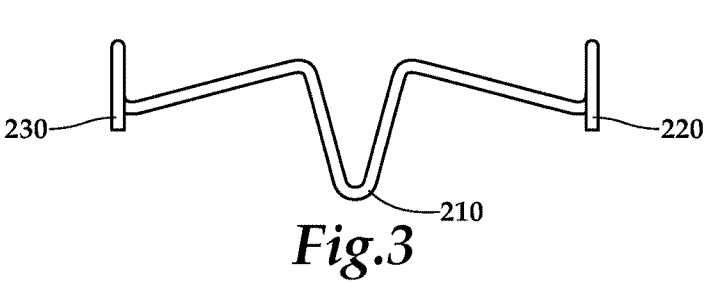
FIG. 3 is a top view of the spring wire clip.

FIG. 3 is a top view of the spring wire clip. It illustrates the V-shaped middle 210 that is designed to fit around the spine of the T-post in a preferred embodiment. Again, this portion of the spring wire clip need not be this exact shape. FIG. 3 also shows the preferred angle the curled ends 220, 230 make with the two arms.

Figure 4:
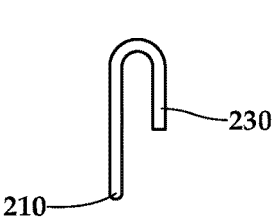
FIG. 4 is a side view of the spring wire clip.

FIG. 4 is side view of the clip. It illustrates the shape of the curl on the side. The curl can be any shape so long as it can be snapped in place and remain in place after installation. In order to function, the clip needs to be curled on either side.

Figure 5:
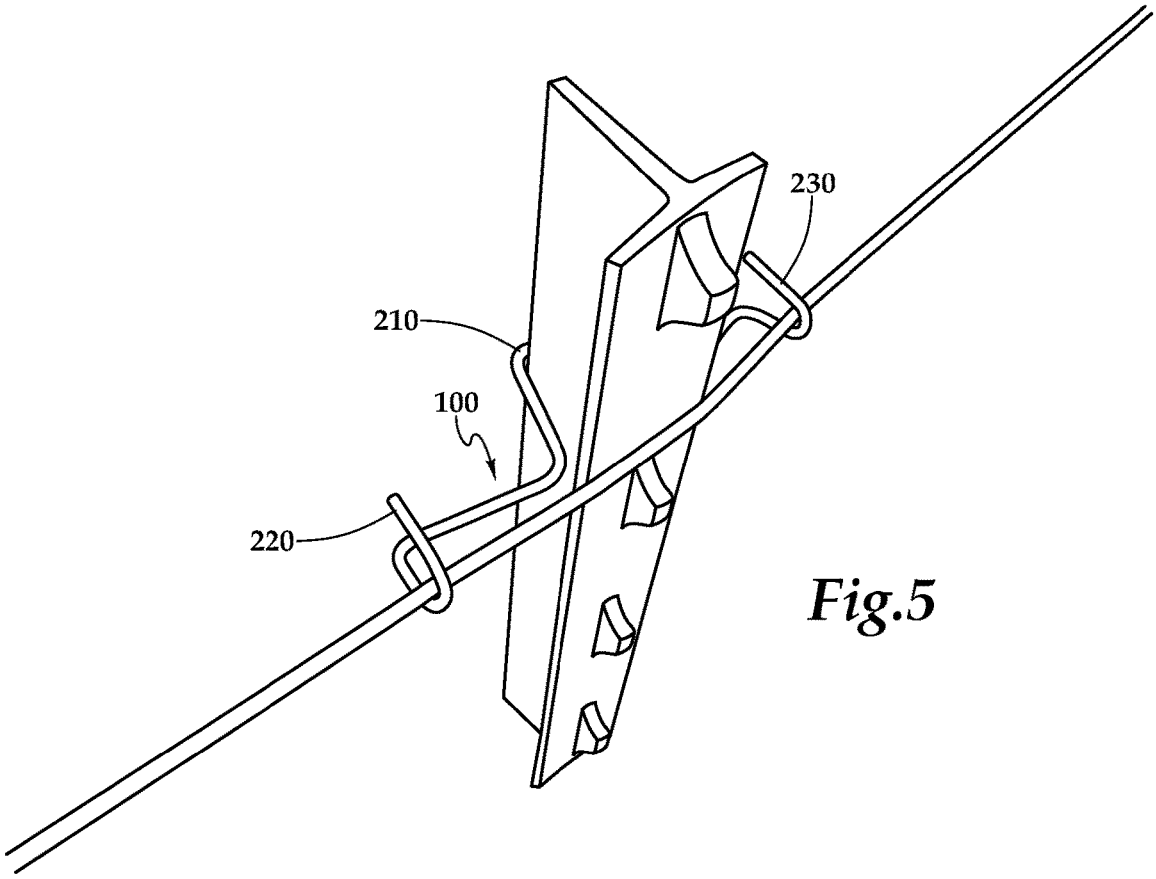
FIG. 5 is a front view of the spring wire clip securing a fence wire on a T-post.

FIG. 5 is a close up front view showing the spring wire clip installed and securing a horizontal fence wire on a T-post. Importantly, the clip can be installed without tools. In a typical installation, first one end is hooked around the fence wire on one lateral side of the T-post. The clip is then drawn behind the T-post so that the other end of the clip can contact the fence wire on the other lateral side of the T-post. The middle of the clip passes behind the T-post on the side containing the spine.

Figure 6:
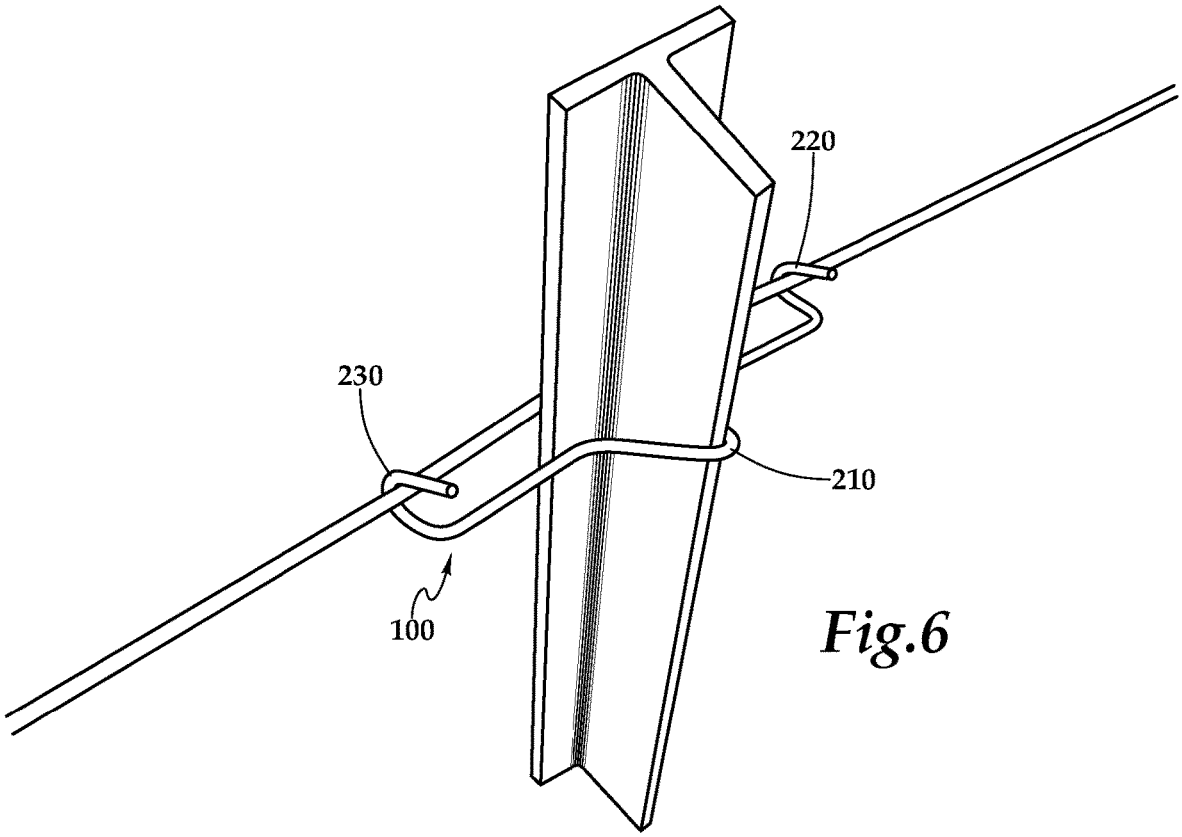
FIG. 6 Illustrates a rear view of the spring wire clip securing a fence wire on a T-post.

This is best seen in FIG. 6, which shows a rear view of the installed spring wire clip. Note the "V" shape fits snugly around the T-post spine.

While the spring wire clips are designed to be installed without any tools, caretakers may find certain common accessories convenient, especially if a large number of clips are to be installed. These tools, such as leather gloves and screw drives, can add comfort and speed to the installation. Caretakers have found that these clips can be installed five times faster than the prior art clips.

The spring wire clips can be used with many types of fence wire: smooth wire, woven wire, barbed wire and high tensile wire. The clips are suitable for uses such as keeping deer off of highways and keeping livestock within a secure area. As stated previously, the two ends are typically symmetrical but need not be. In other words the side arms can be different lengths.

Finally, while carbon spring steel is used as a preferred material any material with the proper tensile strength can function, including various synthetic polymers.

What is claimed is:

1. A spring wire clip suitable for securing fencing wire to a T-post comprising:

a length of clip wire having a shear strength in a range of 125 Ksi to 600 Ksi, said clip wire having a preformed shape comprising:

a first end with a preformed curl configured to engage fencing wire on one lateral side of the T-post, a middle section having a preformed shape allowing the clip to fit around the T-post spine and a second end with a preformed curl configured to engage fencing wire on the other lateral side of the T-post, wherein the spring wire clip has bilateral symmetry and the first and second ends are configured to engage the fencing wire on opposite sides of the T-post.

2. The spring wire clip as defined in claim 1 wherein the fencing wire is selected from the group consisting of barbed wire, smooth wire, woven wire and high tensile wire.

3. The spring wire clip as defined in claim 1 wherein said clip wire has a diameter of 0.075 to 0.15 inches.

4. The spring wire clip as defined in claim 1 wherein said clip wire is high carbon steel spring wire having a shear strength of about 300 Ksi and a diameter of 0.099 to 0.105 inches.

5. The spring wire clip as defined in claim 1 wherein said middle section further comprises a V-shape.

6. The spring wire clip as defined in claim 1 wherein said clip wire is made from a synthetic polymer.

7. The spring wire clip as defined in claim 1 wherein said clip wire shear strength range further comprises 282 Ksi to 312 Ksi.

8. A method of secure attachment of fence wire to a T-post comprising:

a spring wire clip having a length of clip wire having a shear strength in the range of 125 Ksi to 600 Ksi, said clip wire having a preformed shape comprising:

a first end with a preformed curl configured to engage fencing wire on one side of the T-post, a middle section having a preformed shape allowing the clip to fit around the T-post spine and a second end with a preformed curl configured to engage fencing wire on the other side of the T-post, wherein the spring wire clip has bilateral symmetry and the first and second ends are configured to engage the fencing wire on opposite sides of the T-post, said method comprises the steps of:

contacting fence wire to a front side of the T-post, containing studs, said fence wire extending out both lateral sides of the T-post, engaging the fence wire on one lateral side of the T-post with the curl at the clip first end, engaging the fence wire on the other lateral side of the T-post with the curl at the clip second end as the clip middle section contacts the back side of the T-post, containing the spine, and wherein the two end curls of the spring wire clip hold the fence wire to the T-post to form a secure attachment of the fence wire to the T-post.

9. The method as defined in claim 8 wherein the fencing wire is selected from the group consisting of barbed wire, smooth wire, woven wire and high tensile wire.

* * * * *